US008378917B2

(12) United States Patent
Yoneda et al.

(10) Patent No.: US 8,378,917 B2
(45) Date of Patent: Feb. 19, 2013

(54) PROXIMITY ANTENNA AND WIRELESS COMMUNICATION DEVICE

(75) Inventors: Sadaharu Yoneda, Tokyo (JP); Toshinori Matsuura, Tokyo (JP); Tatsuya Fukunaga, Tokyo (JP)

(73) Assignee: TDK Corporation, Tokyo (JP)

( * ) Notice: Subject to any disclaimer, the term of this patent is extended or adjusted under 35 U.S.C. 154(b) by 479 days.

(21) Appl. No.: 12/697,591

(22) Filed: Feb. 1, 2010

(65) Prior Publication Data

US 2010/0194660 A1 Aug. 5, 2010

(30) Foreign Application Priority Data

Jan. 30, 2009 (JP) ..... 2009-019410
Jan. 13, 2010 (JP) ..... 2010-005243

(51) Int. Cl.
*H01Q 21/00* (2006.01)

(52) U.S. Cl. ..... 343/867; 343/866; 343/742

(58) Field of Classification Search ..... 343/867, 343/866, 895, 741, 742
See application file for complete search history.

(56) References Cited

U.S. PATENT DOCUMENTS

| | | | | |
|---|---|---|---|---|
| 4,598,276 | A * | 7/1986 | Tait | 340/572.5 |
| 5,337,063 | A * | 8/1994 | Takahira | 343/741 |
| 7,561,012 | B2 | 7/2009 | Fukunaga | |
| 2005/0093090 | A1 | 5/2005 | Shindo | |
| 2006/0267138 | A1 * | 11/2006 | Kobayashi | 257/531 |
| 2009/0160719 | A1 * | 6/2009 | Kato et al. | 343/742 |

FOREIGN PATENT DOCUMENTS

| | | |
|---|---|---|
| JP | 2005-093867 | 4/2005 |
| JP | 2007-060618 | 3/2007 |
| WO | WO-2005/074402 A2 | 8/2005 |

* cited by examiner

*Primary Examiner* — Hoanganh Le
(74) *Attorney, Agent, or Firm* — McDermott Will & Emery LLP

(57) ABSTRACT

A proximity antenna includes a wiring pattern wound in a predetermined direction in a horizontal plane from a signal end to a ground end and a wiring pattern wound in a direction opposite to the predetermined direction in a horizontal plane from a signal end to a ground end, in which the wiring pattern and the wiring pattern are apposed in a vertical direction. The characteristics of a spiral coil having several turns can be thus obtained by a one-turn wiring width, and an installation space for other components, larger than a conventional installation space, can be therefore secured.

3 Claims, 11 Drawing Sheets

PROXIMITY ANTENNA AND WIRELESS COMMUNICATION DEVICE

TECHNICAL FIELD

The present invention relates to proximity antennas and to wireless communication devices loaded with such proximity antennas.

BACKGROUND OF THE INVENTION

Recently, the performance of compact wireless devices such as mobile phones has been greatly improved, and compact wireless devices ready for non-contact IC cards, such as IC cards compliant with NFC (Near Field Communication) Standard, specifically, MIFARE and Felica, have come on the market. Such a compact wireless device is loaded with a non-contact communication antenna (hereinafter referred to as a proximity antenna) in a frequency of MHz band.

In such a proximity antenna, a spiral coil having several-turns formed on a print substrate by etching is generally used (see, for example, Japanese Patent Application Laid-Open Publication No. 2005-93867). The reason why the spiral coil is provided with the several turns is because less than several turns precludes sufficient communication characteristics. In addition, there is also known an example of a proximity antenna formed by winding a wire several times On the inner surface of a cabinet of a compact wireless device. However, in this type of proximity antenna, the shape thereof may be liable to be collapsed, the antenna characteristics thereof may be liable to be dispersed, and a communication distance may be shortened.

Aside from this, as one of resonator structures, a structure called interdigital coupling is known. In the interdigital coupling, a pair of sheet-shaped resonators are disposed in proximity to each other so that the open ends (signal supply ends) of the resonators face the short-circuit ends thereof, and the interdigital coupling has a feature in that a frequency is separated to a high resonance frequency and a low resonance frequency centering around the resonance frequency of simple resonators. (In what follows, The separated state is called a composite resonance mode.) When the low resonance frequency is used as an operating frequency, an interdigital coupling resonator can more reduce its length than the length of respective resonators when they are used as simple resonators as well as can be obtain good balance characteristics. Further, a conductor loss is also reduced. What has been mentioned above is described in detail in Paragraphs 0038 to 0055 of Japanese Patent Application Laid-Open Publication No. 2007-60618.

With improving the performance of such compact wireless devices, the number of components used has been increased steadily. In such circumstances, the above-mentioned proximity antenna, for example, has a vertical length of 40 mm, a horizontal length of 30 mm, and a wiring width of 4 mm for three-turns and thus occupies a very large area as a component carried by the compact wireless device and reduces the installation area of other component. In addition, such a proximity antenna has a problem in that the antenna characteristics thereof are deteriorated only by a metal component located near to the proximity antenna (in particular, located just under a coil conductor), and this is a difficult problem in a layout of components.

SUMMARY OF THE INVENTION

Accordingly, one embodiment of the present invention is directed at providing a proximity antenna capable of securing an installation space for other components, larger than a conventional installation space, and a wireless communication device loaded with the proximity antenna.

A proximity antenna according to an embodiment of the present invention includes a first loop antenna wound in a predetermined direction in a horizontal plane from a signal end to a ground end and a second loop antenna wound in a direction opposite to the predetermined direction in a horizontal plane from a signal end to a ground end, in which the first loop antenna and the second loop antenna are apposed in a vertical direction.

According to an embodiment of the present invention, the characteristics of several turns of a spiral coil can be obtained by a wiring width of one-turn. Therefore, the installation space for other components, larger than a conventional installation space, can be secured.

The proximity antenna may further include a substrate including an insulating material and the first loop antenna may be formed on one surface of the substrate and the second loop antenna may be formed on the other surface of the substrate. Thus, the first loop antenna and the second loop antenna can be apposed in a vertical direction.

Further, in the proximity antenna, the substrate may have first to third pad electrodes formed on the one surface, fourth to sixth pad electrodes formed on the other surface, a first through hole conductor for connecting the first pad electrode to the fourth pad electrode, a second through hole conductor for connecting the second pad electrode to the fifth pad electrode, and a third through hole conductor for connecting the third pad electrode to the sixth pad electrode, the first pad electrode may be connected to a signal end of the first loop antenna, the second pad electrode may be connected to a ground end of the first loop antenna, the fifth pad electrode may be connected to a ground end of the second loop antenna, and the sixth pad electrode is connected to a signal end of the second loop antenna. Thus, since both of the surfaces of the substrate has a symmetric structure, a design for disposing the proximity antenna to a communication device can be easily carried out.

Further, a wireless communication device according to an embodiment of the present invention has a feature in that the respective proximity antennas described above are mounted thereon.

According to an embodiment of the present invention, there can be provided a proximity antenna which can secure an installation space for other components, larger than a conventional installation space.

DESCRIPTION OF THE PREFERRED EMBODIMENTS

Preferred embodiments of the present invention will be described below in detail referring to the accompanying drawings.

Figure 1:
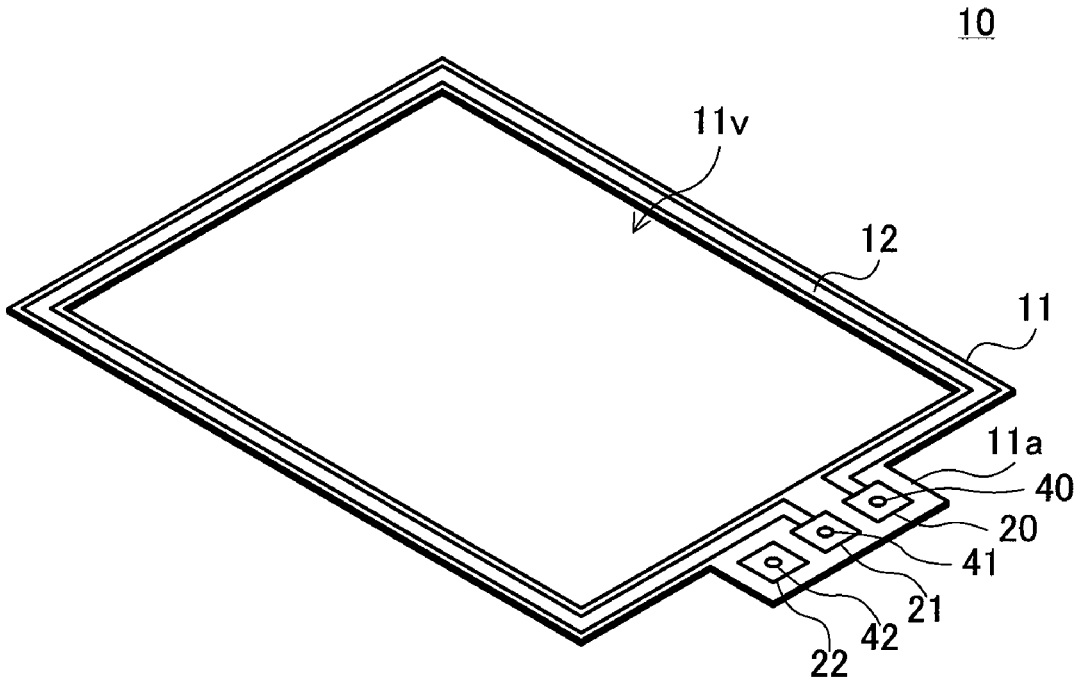
FIG. 1 is a schematic perspective view illustrating an overview of a proximity antenna according to the preferred embodiment of the present invention.
Figure 2A:
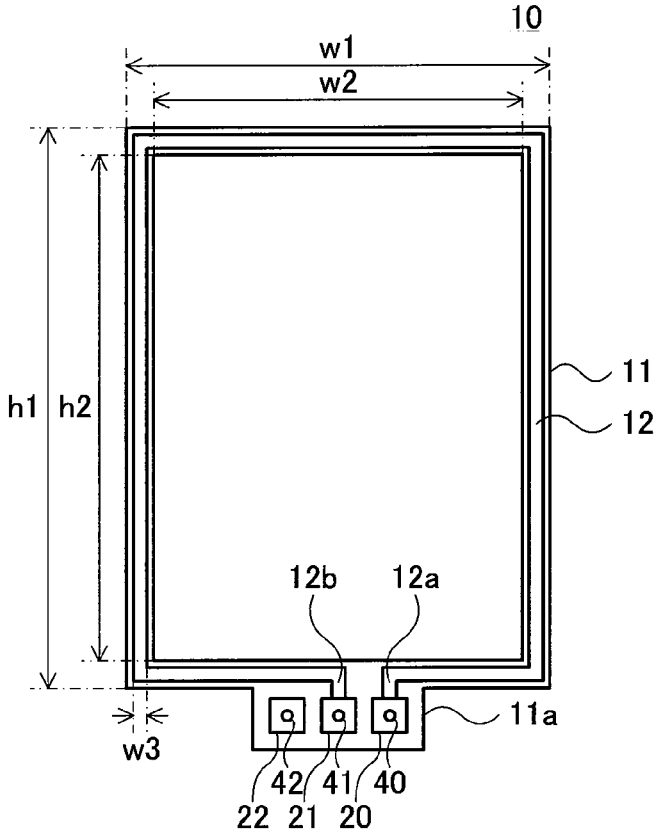
FIGS. 2A and 2B are plan views of the proximity antenna according to the preferred embodiment of the present invention when it is viewed from a front surface and from a back surface, respectively.
Figure 2B:
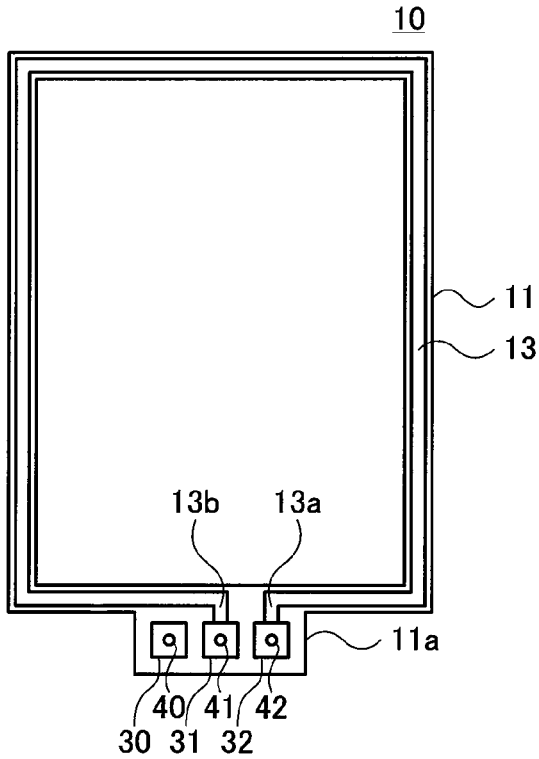
Figure 3:
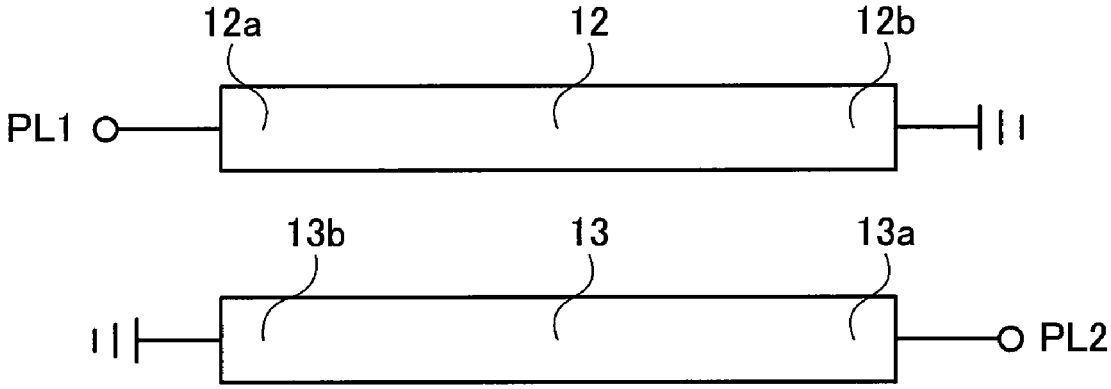
FIG. 3 is a schematic view illustrating a connecting relation to the proximity antenna according to the preferred embodiment of the present invention.

FIG. 1 is a schematic perspective view illustrating an overview of a proximity antenna 10 according to the embodiment. FIGS. 2A and 2B are plan views of the proximity antenna 10 when it is viewed from a front surface and from a back surface, respectively. Further, FIG. 3 is a schematic view illustrating a connecting relation to the proximity antenna 10.

As illustrated in FIG. 1 and FIGS. 2A and 2B, the proximity antenna 10 includes an approximately annular substrate 11 having a land-like projection 11*a*, an approximately annular wiring pattern 12 (a first loop antenna) formed on the front surface of the substrate 11, an approximately annular wiring pattern 13 (a second loop antenna) formed on the back surface of the substrate 11, pad electrodes 20 to 22 (first to third pad electrodes) formed on the front surface of the projection 11*a*, pad electrodes 30 to 32 (fourth to sixth pad electrodes) formed on the back surface of the projection 11*a*, and through hole conductors 40 to 42 (first to third through hole conductors) formed to the projection 11*a*.

Note that it is not indispensable to include the land-like projection 11*a*. That is, a location where the pad electrodes are formed is not necessarily the projection 11*a*, and the pad electrodes can be also formed in, for example, an annular portion of the substrate 11.

The substrate 11 includes an insulating material such as glass epoxy, polyimide, polyethylene, aramid, paper phenol, paper epoxy, polyester or ceramic. The substrate 11 has a rectangular outside shape except the projection 11*a*. The central portion (portion surrounded by wiring patterns 12 and 13) of substrate 11 is arranged as a hollow opening 11*v*.

The wiring patterns 12 and 13, the pad electrodes 20 to 22 and 30 to 32, and the through hole conductors 40 to 42 include conductor materials such as aluminum, copper, silver, nickel and gold. As described later, since each of the wiring patterns 12 and 13 constitute a one-turn loop antenna, the conductor widths of the wiring patterns 12 and 13 are equal to the wiring widths thereof.

The wiring pattern 12 constitutes the one-turn loop antenna (first loop antenna) wound counterclockwise when viewed from the front surface side of the substrate 11 in a horizontal plane from one end 12*a* to the other end 12*b*. Both of the ends 12*a* and 12*b* are connected to the pad electrodes 20 and 21, respectively. The wiring pattern 13 constitutes the one-turn loop antenna (second loop antenna) wound clockwise when viewed from the front surface side of the substrate 11 in a horizontal plane from one end 13*a* to the other end 13*b*. Both of the ends 13*a* and 13*b* are connected to the pad electrodes 32 and 31, respectively. The pad electrodes 20 and 30, the pad electrodes 21 and 31, and the pad electrodes 22 and 32 are disposed at the positions, where they correspond to each other, on the front surface and on the back surface of the substrate 11 and are connected by the through hole conductors 40 to 42, respectively.

As illustrated in FIG. 3, when the proximity antenna 10 is used, the one end 12*a* (pad electrode 20) and the one end 13*a* (pad electrode 22) are connected to a pair of signal lines PL1 and PL2. The other ends 12*b* and 13*b* (pad electrode 21) are connected to the ground together. Specific examples of the signal lines PL1 and PL2 include signal lines used in IC cards compliant with NFC (Near Field Communication) Standard. More specific examples thereof include signal lines used in a differential transmission system. In such cases, the proximity antenna 10 may be carried by compact wireless communication devices such as IC cards or mobile phones having IC card functions.

With such arrangement, both of the ends 12*a* and 12*b* of the wiring pattern 12 constitute open ends (signal supply ends) and short-circuit ends, respectively, and both of the ends 13*a* and 13*b* of the wiring pattern 13 also constitute open ends (signal supply ends) and short-circuit ends, respectively, as illustrated in FIG. 3. Then, the open end of the wiring pattern 12 faces the short-circuit end of the wiring pattern 13 and the open end of the wiring pattern 13 faces the short-circuit end of the wiring pattern 12, respectively. That is, the proximity antenna 10 has a structure corresponding to the interdigital coupling resonator described above.

Interdigital coupling will be explained below in detail.

Figure 4A:
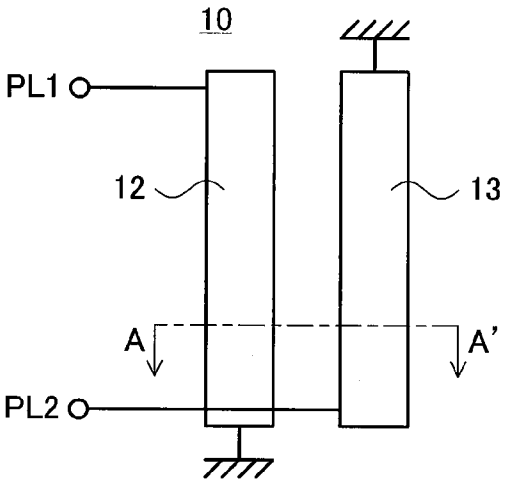
FIG. 4A is a plan view of an antenna having resonators interdigitally coupled with each other.
Figure 4B:
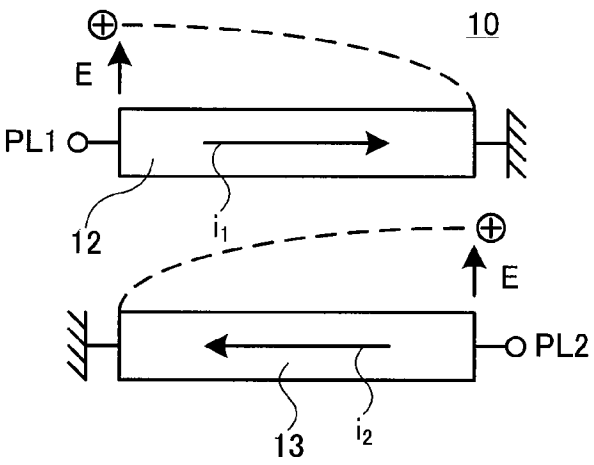
FIG. 4B is a view showing currents flowing to the resonators and distributions of electric fields E generated in the resonators when it is assumed that an operating frequency of the antenna showed in FIG. 4A is a resonance frequency $f_1$.
Figure 4C:
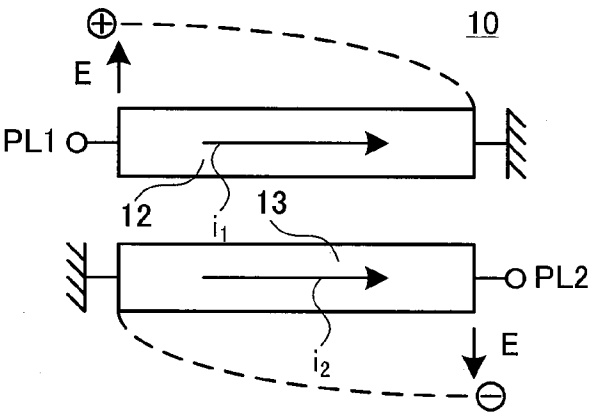
FIG. 4C is a view showing currents flowing to the resonators and distributions of electric fields E generated in the resonators when it is assumed that an operating frequency of the antenna showed in FIG. 4A is a resonance frequency $f_2$.
Figure 4D:
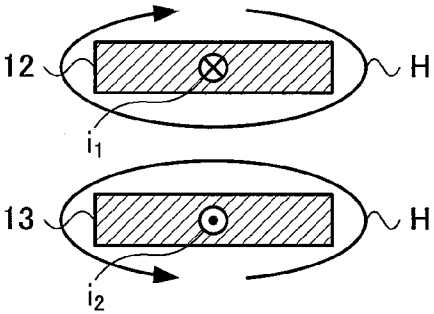
FIG. 4D is a sectional view taken along A-A' line of FIG. 4A and shows distributions of magnetic fields H generated around the resonators when it is assumed that the operating frequency of the antenna is the resonance frequency $f_1$.
Figure 4E:
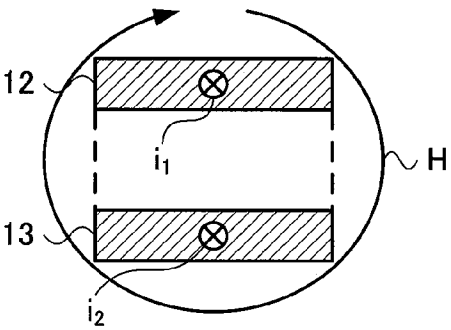
FIG. 4E is a sectional view taken along A-A' line of FIG. 4A and shows distributions of magnetic fields H generated around the resonators when it is assumed that the operating frequency of the antenna is the resonance frequency $f_2$.

FIG. 4A is a plan view of an antenna 10 having resonators 12, 13 interdigitally coupled with each other. FIG. 4B is a view showing currents $i_1$, $i_2$ flowing to the resonators 12, 13 and distributions of electric fields E generated in the resonators 12, 13 when it is assumed that an operating frequency of the antenna 10 is a resonance frequency $f_1$. FIG. 4C is a view showing currents $i_1$, $i_2$ flowing to the resonators 12, 13 and distributions of electric fields E generated in the resonators 12, 13 when it is assumed that the operating frequency of the antenna 10 is a resonance frequency $f_2$. FIGS. 4D and 4E are both sectional views taken along A-A' line of FIG. 4A. FIG. 4D shows distributions of magnetic fields H generated around the resonators 12, 13 when it is assumed that the operating frequency of the antenna 10 is the resonance frequency $f_1$. In contrast, FIG. 4E shows a distribution of a magnetic field H generated around the resonators 12, 13 when it is assumed that the operating frequency of the antenna 10 FIGS. 4D and 4E show also directions of the currents $i_1$, $i_2$.

As shown in FIG. 4A, the antenna 10 has such an arrangement that a pair of the resonators 12, 13 is disposed in proximity to each other, and open ends (signal supply ends) and short-circuit ends of the respective resonators 12, 13 confront with each other. The resonance frequencies $f_1$, $f_2$ of the antenna 10 are separated from each other to high and low frequencies (the resonance frequencies $f_1$, $f_2$) by a frequency interval D centering around a resonance frequency $f_0$ in a simple resonator. A higher coupling degree more separates the resonance frequencies $f_1$, $f_2$ from the resonance frequency $f_0$. That is, the frequency interval D increases between the resonance frequencies $f_0$ and $f_1$ and between the resonance frequencies $f_0$ and $f_2$.

Although a shorter resonator more increases the resonance frequency $f_0$ in the simple resonator, the antenna 10 can obtain the resonance frequency $f_2$ in a lower band. Accordingly, using the resonance frequency $f_2$ as the operating frequency can more reduce a length of the resonators 12, 13 than a case where the resonators 12, 13 are used simply, respectively.

Incidentally, using the resonance frequency $f_2$ as the operating frequency has also other advantages. When the resonance frequency $f_2$ is used as the operating frequency, as shown in FIG. 4C, the currents $i_1$, $i_2$ flowing to the resonators 12, 13 become currents in the same direction, and further phases of the electric fields E are different from each other by 180° at bilaterally symmetrical positions between the resonators 12 and 13. That is, since an electromagnetic wave is excited in an inverted phase, when the resonance frequency $f_2$ is used as the operating frequency, an equilibrium signal used in the differential transmission system can be transmitted in a state excellent in balance characteristics. That is, the antenna 10 is arranged as a transmission antenna for transmitting an equilibrium signal input from the pair of signal lines PL1, PL2 as an electromagnetic wave or as a reception antenna for outputting an electromagnetic wave, which is received by the antenna 10, from the pair of signal lines PL1, PL2 as an equilibrium signal.

Further, as shown in FIG. 4E, the distribution of the magnetic field H generated around the resonators 12, 13 becomes the same as a distribution which is created when the resonators 12, 13 are regarded as one conductor. This means that a thickness of a conductor virtually increases and thus a conductor loss is reduced.

In contrast, when the resonance frequency $f_1$ is used as the operating frequency, the advantages described above cannot be obtained. More specifically, when the resonance frequency $f_1$ is used as the operating frequency, as shown in FIG. 4B, the currents $i_1$, $i_2$ flowing to the resonators 12, 13 become currents in a reverse direction, and further the resonators 12 and 13 have the same phase of the electric fields E. That is, since an electromagnetic wave is excited in the same phase, the balance characteristics of the equilibrium signal used in the differential transmission system are degraded. Further, as shown in FIG. 4D, since the magnetic fields H are cancelled by the resonators 12 and 13, an electric loss increases.

Since the interdigital coupling has the characteristics as described above, when the proximity antenna 10 uses the lower resonance frequency $f_2$ as the operating frequency, lengths of respective wiring patterns can be made shorter than when the resonators are used as simple resonators, and good balance characteristics and a smaller conductor loss can be realized.

To obtain the above advantage, it is indispensable to connect the other ends 12*b* and 13*b* of the respective wiring patterns of the proximity antenna 10 to the ground. This will be described below in detail.

Figure 5A:
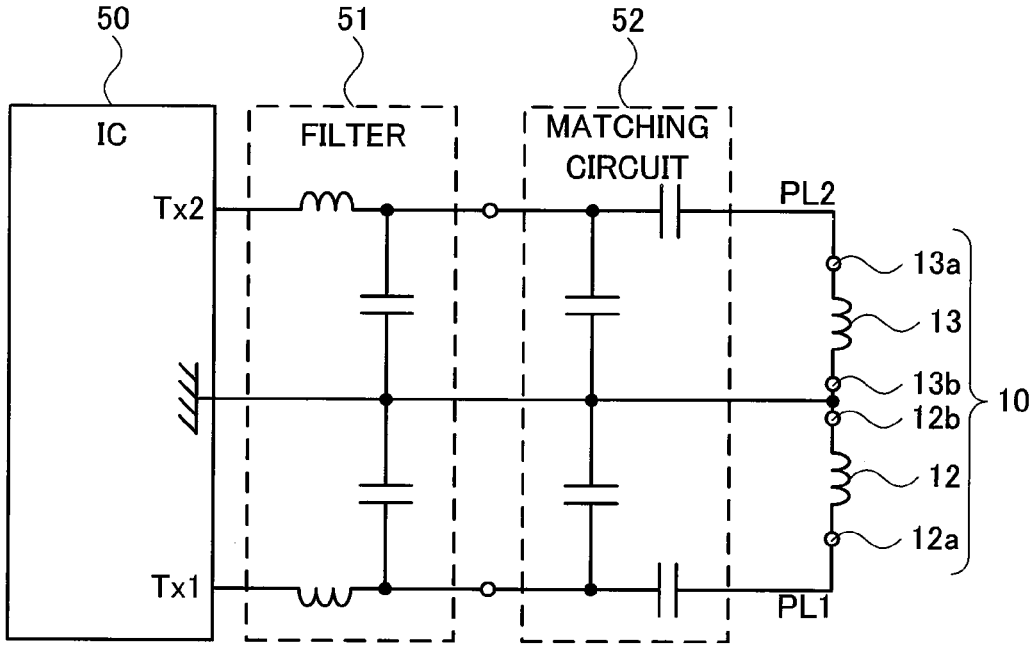
FIG. 5A is a view illustrating a circuit arrangement of a compact wireless communication device using the proximity antenna according to the preferred embodiment of the present invention.

FIG. 5A is a view illustrating a circuit arrangement of a compact wireless communication device using the proximity antenna 10. As illustrated in FIG. 5A, a main body portion 50 of a non-contact IC card is carried by the compact wireless communication device. The main body portion 50 has terminals Tx1 and Tx2 which are connected to the signal lines PL1 and PL2, respectively. A filter 51 and a matching circuit 52 are disposed to the signal lines PL1 and PL2.

As illustrated in FIG. 5A, the filter 51 has LC filters disposed to the respective signal lines, and capacitors constituting the LC filters are interposed between the respective signal lines and the ground. Further, the matching circuit 52 also has matching circuits which are disposed to the signal lines and each of which include two capacitors, and one of the capacitors of each matching circuit is interposed between the signal line and the ground. As described above, any of the other ends 12*b* and 13*b* of the respective wiring patterns of the proximity antenna 10 is connected to the ground. When the above circuit arrangement is employed, it seems as if the wiring patterns 12 and 13 act as individual antennas when viewed from the circuit side. Accordingly, the respective wiring patterns 12 and 13 are interdigitally coupled, and a resonance frequency is separated to a high resonance frequency and a low resonance frequency centering around the resonance frequency of the respective simple wiring patterns. With this arrangement, the length of the respective wiring patterns can be made shorter as compared with a case that the respective wiring patterns are used as simple wiring patterns as well as a good balance characteristics and a smaller conductor loss can be realized as described above.

Figure 5B:
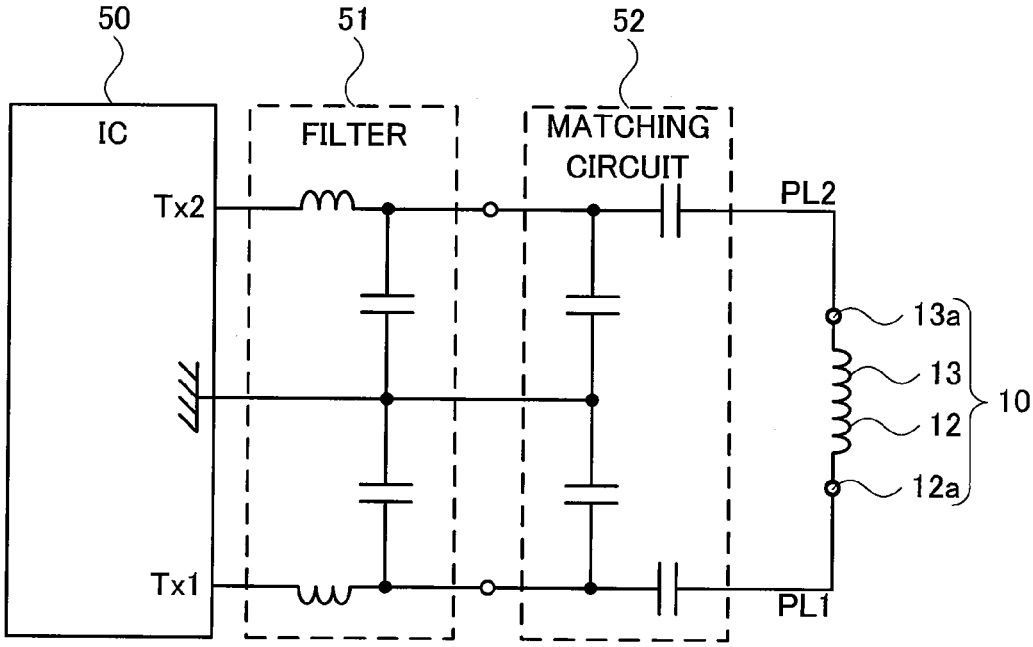
FIG. 5B is a view illustrating a circuit arrangement of a compact wireless communication device when other ends of respective wiring patterns of a proximity antenna are not connected to the ground.

When the other ends 12*b* and 13*b* of the respective wiring patterns of the proximity antenna 10 are not connected to the ground as illustrated in FIG. 5B, it seems as if the wiring patterns 12 and 13 act as one antenna when viewed from the circuit side. Accordingly, in the circuit arrangement, since the respective wiring patterns 12 and 13 are not interdigitally coupled, the advantage described above can not be obtained.

According to the proximity antenna 10 described above, since the proximity antenna 10 has a structure corresponding to the interdigital coupling, the length of the wiring patterns 12 and 13 can be more shortened than a conventional length as well as the good balance characteristics and the smaller conductor loss are realized. Specifically, the characteristics of several turns of a spiral coil can be obtained by a wiring width of one-turn.

The advantage described above will be specifically described while showing the results of a simulation and an experiment. Example 1 and Comparative Example 1 as described below were used in the simulation, and Example 2 and Comparative Example 2 as described below were used in the experiment.

First, the simulation will be described.

FIGS. 1, 2A and 2B illustrate a proximity antenna 10 according to Example 1. In the proximity antenna 10, a substrate 11 had a height h1 set at about 40 mm and a width w1 set at about 30 mm. Further, wiring patterns 12 and 13 had a conductor width w3 set at about 1.0 mm. Accordingly, a wiring width was set also to about 1.0 mm. The thickness of a copper foil constituting the wiring patterns 12 and 13 was set at 35 μm. Further, the width of a margin of the substrate 11 was set at about 0.1 mm. Accordingly, the size of an opening 11*v* of the substrate 11 was such that a height h2 was set at about 37.6 mm and a width w2 was set at about 27.6 mm.

Figure 6:
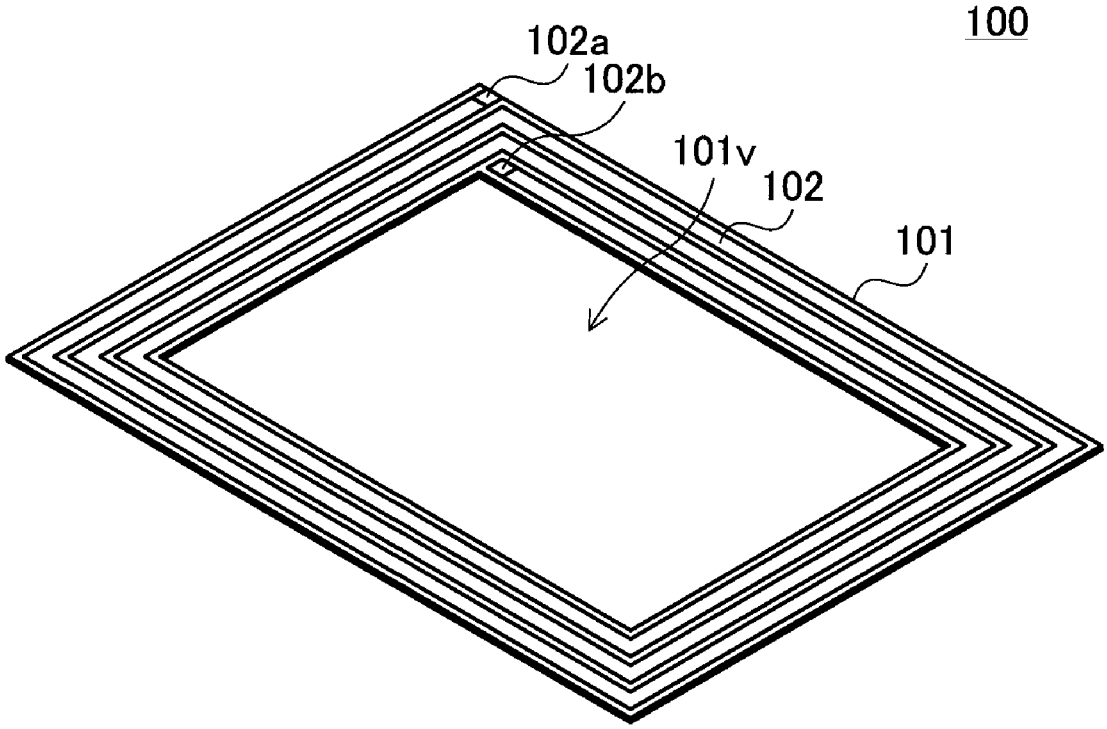
FIG. 6 is a schematic perspective view illustrating an overview of a proximity antenna according to Comparative Example 1.

FIG. 6 is a schematic perspective view illustrating an overview of a proximity antenna 100 according to Comparative Example 1. The proximity antenna 100 had an annular substrate 101 and a spiral coil 102 formed on the front surface of the substrate 101. A pair of signal lines (not shown) were connected to both ends 102*a* and 102*b* of the spiral coil 102. The size of the substrate 101 was set at about 40 mm×about 30 mm likewise the size of the proximity antenna 10, and the conductor width of the spiral coil 102 was set at about 1.3 mm. The thickness of a copper foil constituting the spiral coil 102 was set at 35 μm. Further, the inter-line distance of the spiral coil 102 and the width of a margin of the substrate 101 were set at about 0.1 mm. Since the spiral coil 102 had three-turns, a wiring width was larger than that of the proximity antenna 10 and set at 4.3 mm including a margin between conductors. Further, the size of an opening 101*v* of the substrate 101 was about 31.4 mm×about 21.4 mm.

Figure 7:
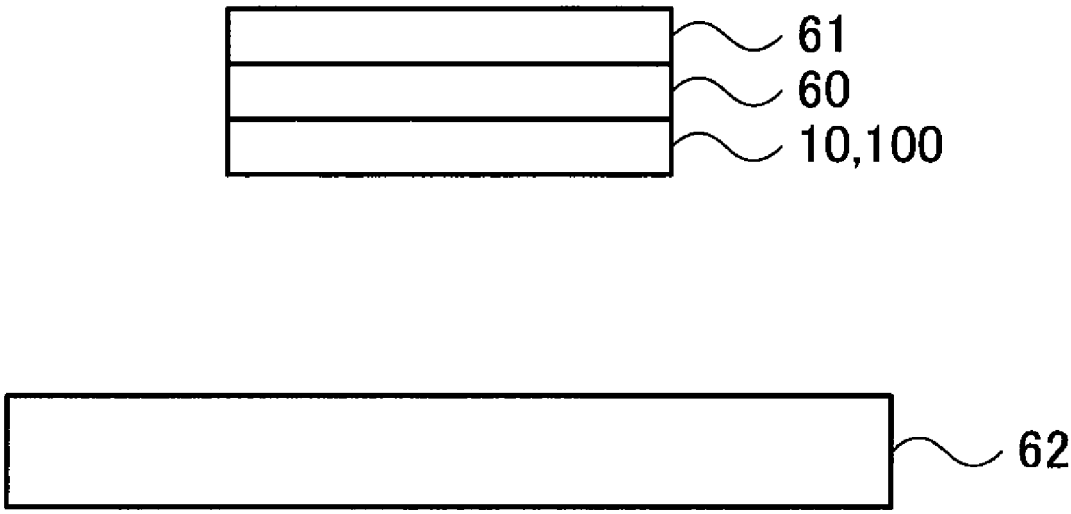
FIG. 7 is a view illustrating an arrangement in the simulation for confirming the effect of the proximity antenna according to the preferred embodiment of the present invention.

FIG. 7 is a view illustrating an arrangement in the simulation. As illustrated in FIG. 7, it was assumed that a magnetic sheet 60 and a metal sheet 61 were bonded to the back side of the substrate of each of the proximity antennas in this order. This arrangement reproduced an environment in a compact wireless communication device in a pseudo manner. Commercially available RFID reader/writers 62 were approached to the surfaces from which the proximity antennas 10 and 100 were exposed, and amounts of power, which were transmitted to the proximity antennas 10 and 100 when power was input to the RFID reader/writer 62 in the state, were simulated using electromagnetic field analyzing software HFSS of Anasoft. Specifically, the power appeared between the pad electrodes 20, 22 of the proximity antenna 10 and the power appeared between the one end 102*a* and the other end 102*b* of the proximity antenna 100 were simulated. A power value obtained by the above arrangement is called "a power transmission efficiency (also called a power transmission characteristic or an S21 value)", and a larger value means that a larger amount of power is transmitted.

A spiral coil similar to the proximity antenna 100 was used as an antenna disposed to the RFID reader/writer 62 side, and the size of the spiral coil was set at about 104 mm×about 67 mm. The spiral coil was made by modeling an antenna actually used in a ticket gate. The simulation was carried out in a state that the center axes of the respective antennas were aligned.

Figure 8A:
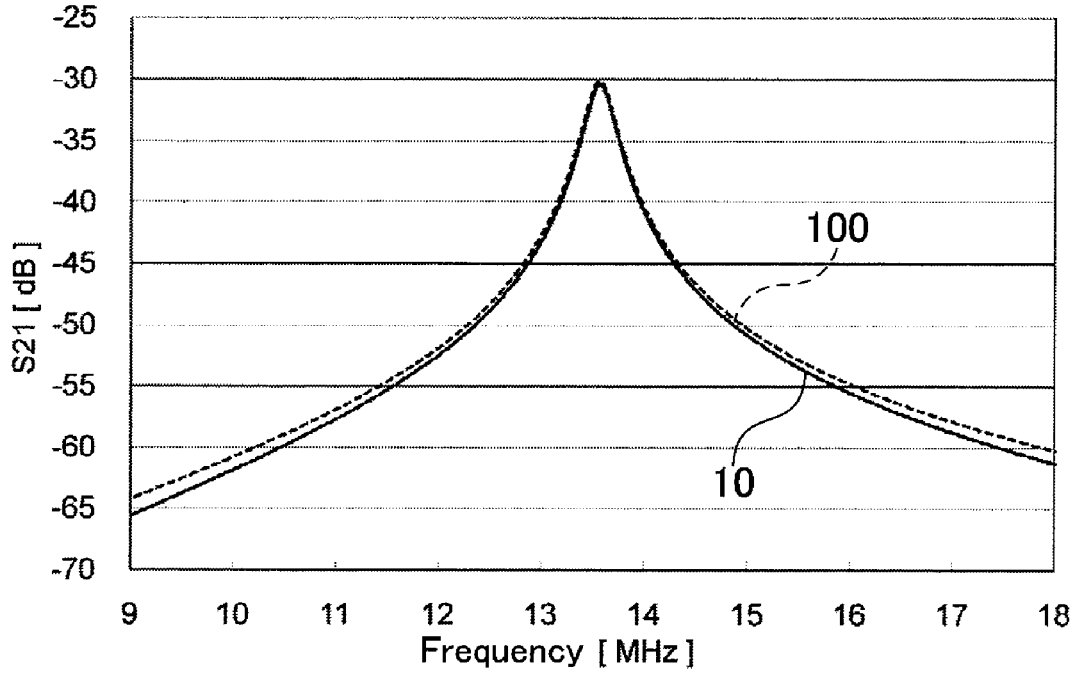
FIG. 8A is a graph illustrating "a power transmission efficiency", which is obtained as a result of the simulation, with respect to a frequency and illustrates a relatively wide frequency band including an operating frequency.
Figure 8B:
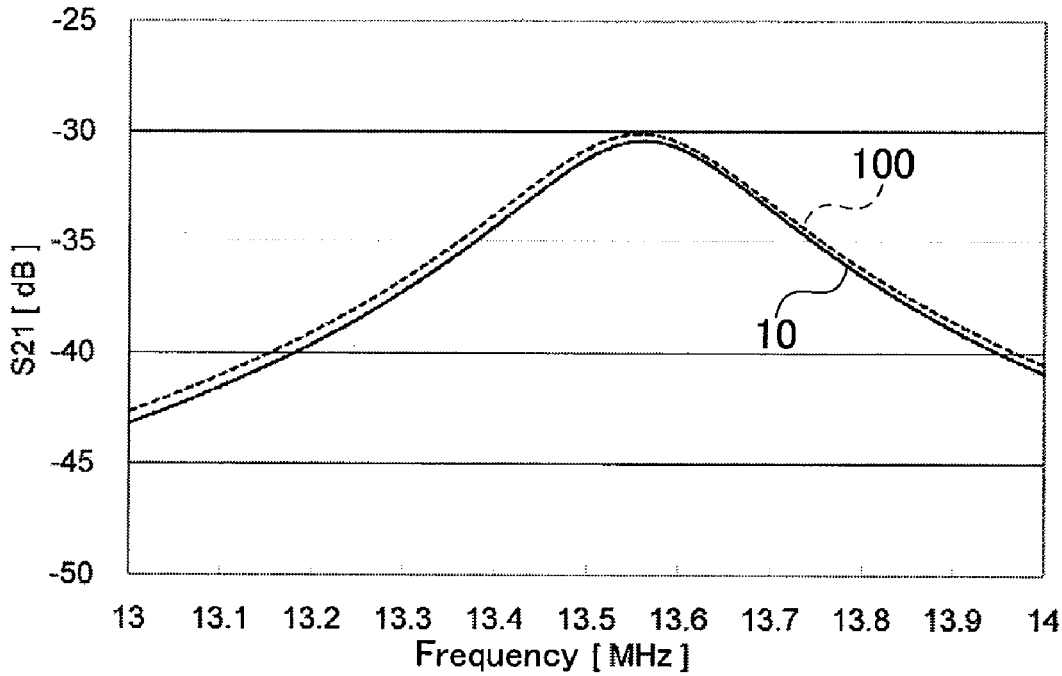
FIG. 8B is a graph illustrating "a power transmission efficiency", which is obtained as a result of the simulation, with respect to a frequency and illustrates a relatively narrow frequency band only in the vicinity of the operating frequency.

FIGS. 8A and 8B are graphs illustrating "a power transmission efficiency", which is obtained as a result of the simulation, with respect to a frequency. FIG. 8A illustrates a relatively wide frequency band including an operating frequency $f_2$ (=13.56 MHz), and FIG. 8B illustrates a relatively narrow frequency band only in the vicinity of the operating frequency $f_2$. As illustrated in FIGS. 8A and 8B, approximately the same result was obtained in the proximity antenna 100 and the proximity antenna 10 including the "a power transmission efficiency" in the operating frequency $f_2$. The result shows that the same characteristics as those of the proximity antenna 100 having a wiring width of three-turns of a spiral coil can be obtained by the proximity antenna 10 having a one-turn wiring width.

The experiment will be described below.

Figure 9A:
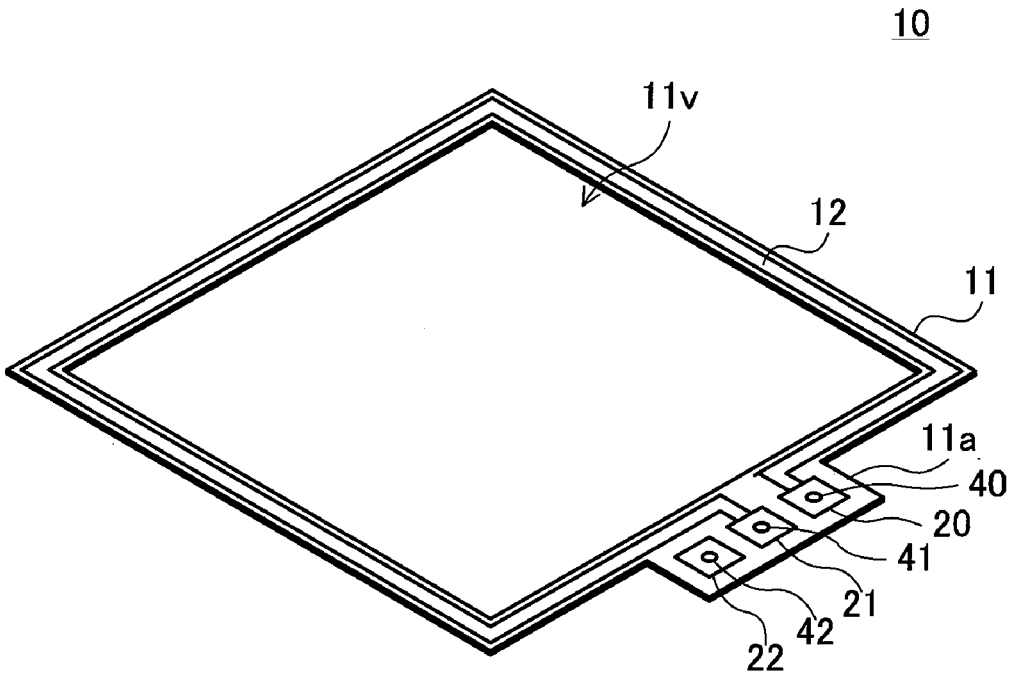
FIG. 9A is a schematic perspective view illustrating an overview of a proximity antenna according to Example 2 of the preferred embodiment of the present invention.

FIG. 9A is a schematic perspective view illustrating an overview of a proximity antenna 10 according to Example 2. Although a back surface is not shown, a wiring pattern 13 and the like were formed on the back surface likewise the proximity antenna 10 illustrated in FIG. 2B. In the proximity antenna 10, a substrate 11 was formed to a square of about 35 mm×about 35 mm. Further, the wiring patterns 12 and 13 had a conductor width set at about 1.0 mm. Accordingly, a wiring width was also set at about 1.0 mm. The thickness of a copper foil constituting the wiring patterns 12 and 13 was set at 35 μm. Further, the width of a margin of the substrate 11 was set at about 0.1 mm. Accordingly, the size of an opening 11*v* of the substrate 11 was about 32.6 mm×about 32.6 mm.

Figure 9B:
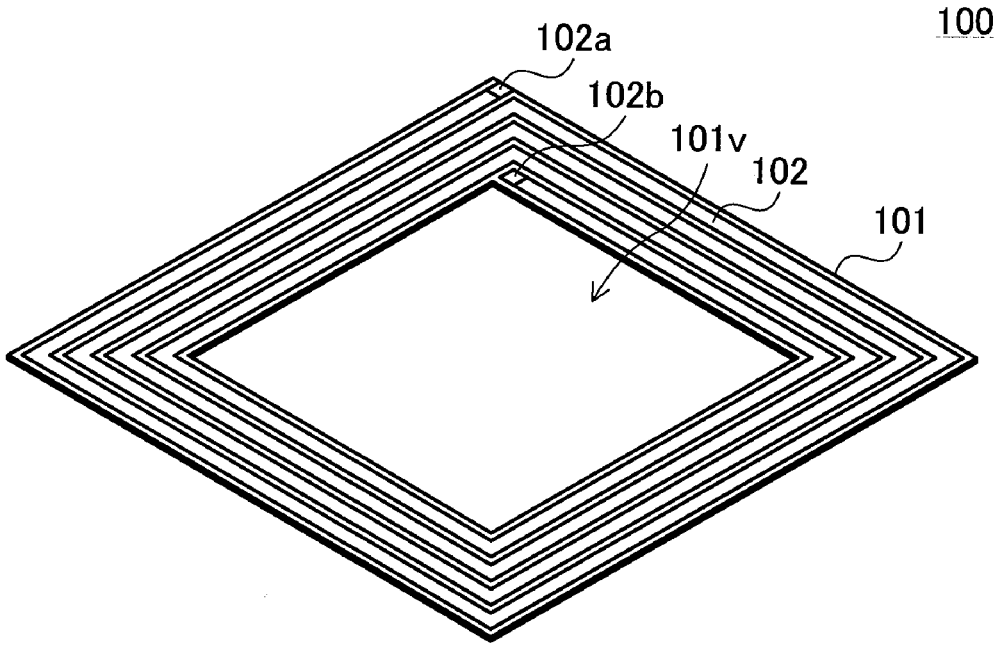
FIG. 9B is a schematic perspective view illustrating an overview of a proximity antenna according to Comparative Example 2.

FIG. 9B is a schematic perspective view illustrating an overview of a proximity antenna 100 according to Comparative Example 2. The proximity antenna 100 according to Comparative Example 2 also had the annular substrate 101 and a spiral coil 102 formed on the front surface of the substrate 101. A pair of signal lines (not shown) were connected to both of the ends 102*a* and 102*b* of the spiral coil 102. The size of the substrate 101 and the conductor width of the spiral coil 102 were equal to those of the proximity antenna 10. That is, the size of the substrate 101 was set at about 35 mm×about 35 mm, and the conductor width of the spiral coil 102 was set at about 1.0 mm. The thickness of a copper foil constituting the spiral coil 102 was set at 35 μm. Further, the inter-line distance of the spiral coil 102 and the width of a margin of the substrate 101 were set at about 0.5 mm. Since the spiral coil 102 had four-turns, a wiring width was larger than that of the proximity antenna 10 and was set at 6.5 mm including a margin between conductors. Further, the size of an opening 101*v* of the substrate 101 was about 22 mm×about 22 mm.

Figure 10:
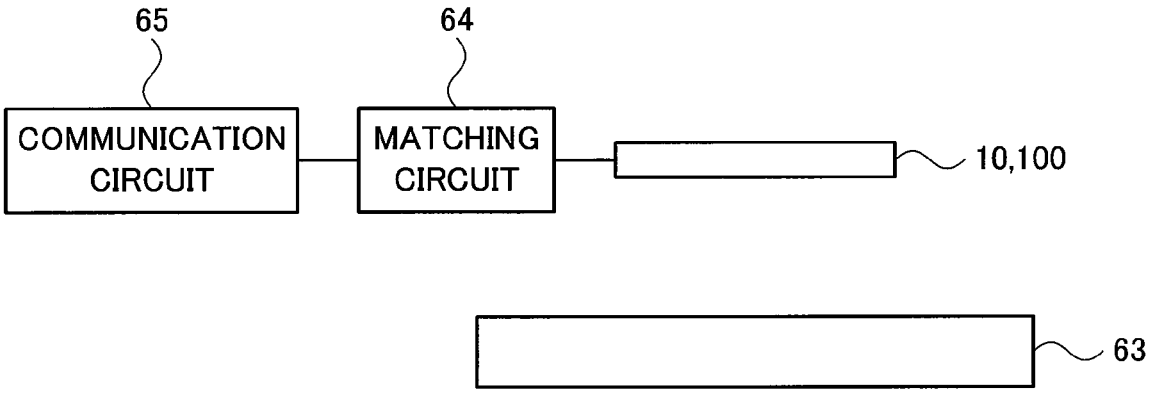
FIG. 10 is a view illustrating an arrangement of the experiment for confirming the effect of the proximity antenna according to the preferred embodiment of the present invention.

FIG. 10 is a view illustrating an arrangement of the experiment. As illustrated in FIG. 10, a commercially available RFID reader/writer 63 was approached to the proximity antennas 10 and 100, and a read signal was output from the RFID reader/writer 63 in the state. Communication circuits 65 were attached to the proximity antennas 10 and 100 through matching circuits 64 so that the read signal received by the proximity antennas 10 and 100 could be detected.

A spiral coil similar to the proximity antenna 100 was used as an antenna disposed to the RFID reader/writer 63 side, and the size of the spiral coil was set at about 54 mm×about 35 mm. Further, any of the proximity antennas 10 and 100 and the antenna on the RFID reader/writer 63 side included an air core (a state in which a peripheral environment of metal and the like did not exist), and the experiment was carried out in a state that the center axes of the respective antennas were aligned.

As a result of the experiment, the maximum communication possible distances of the proximity antennas 10 and 100 were 56 mm and 52 mm, respectively. It is understood from the above result that characteristics, which are equivalent to or better than those of the proximity antenna 100 having a wiring width of four-turns of a spiral coil can be obtained by the proximity antenna 10 having the wiring width of the one-turn.

As described above, according to the proximity antenna 10, the characteristics of several turns of a spiral coil can be obtained by a wiring width of one-turn. Therefore, an installation space for other component (the opening 11*v* of the substrate 11), larger than a conventional installation space, can be secured. Since the area occupied by the wirings is made small, the effect of a back surface metal is also reduced.

In the proximity antenna 10, the wiring patterns 12 and 13 can be apposed (arranged adjacent to each other) in a vertical direction using both of the surfaces of the substrate 11. Accordingly, even if respective wiring patterns are formed in a one-turn, the width of the one-turn is sufficient as the wiring width.

Since both of the surfaces of the substrate 11 has a symmetric structure, a design for disposing the proximity antenna 10 to a communication device can be easily carried out.

The preferred embodiments of the present invention have been described above. The present invention is not limited to such embodiments at all. Needless to say, the present invention can be embodied in various forms in the scope without departing from its purport.

For example, in the embodiment, although an opening 11*v* is formed to the substrate 11, characteristics of the antenna 10 as an antenna are not changed even if the opening 11*v* is not formed. Accordingly, when the opening 11*v* is not necessary due to a specific disposition mode and a shape of other parts, it is not necessarily required to form the opening 11*v*.

Figure 11:
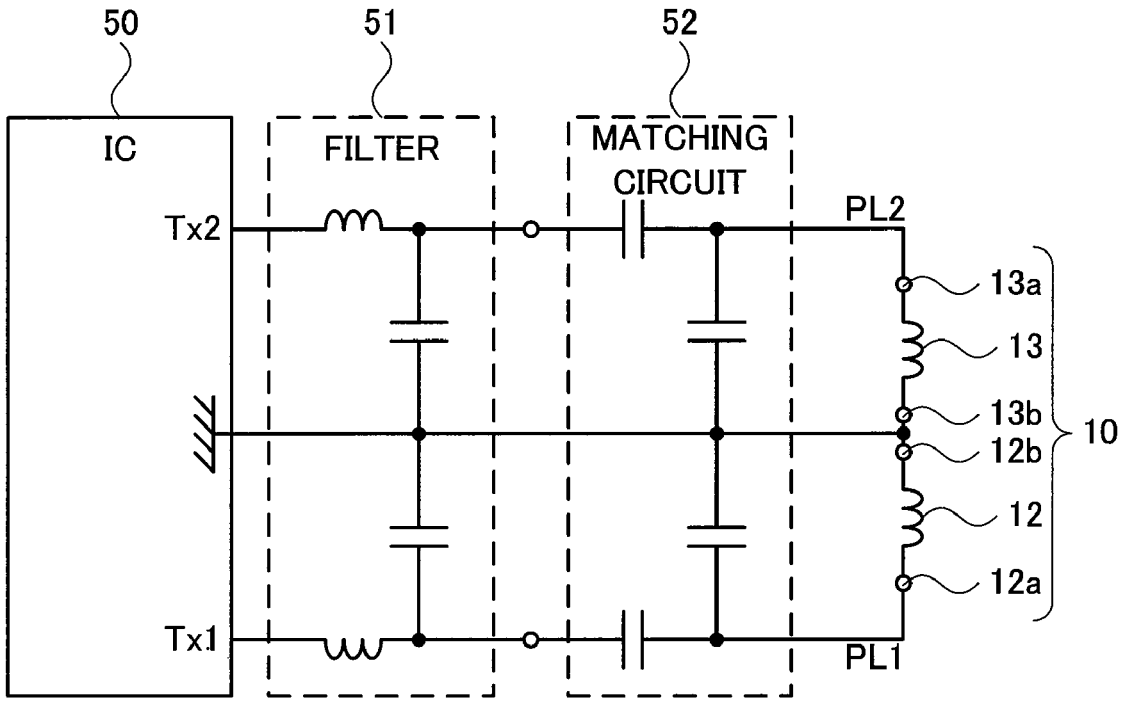
FIG. 11 shows a circuit arrangement of a compact wireless communication device including a matching circuit of other example of the preferred embodiment of the present invention.

Further, a specific circuit arrangement of a matching circuit 52 is not limited to the one shown in FIG. 5A. FIG. 11 shows a circuit arrangement of a compact wireless communication device including a matching circuit 52 of other example. When the example is compared with the example shown in FIG. 5A, a capacitor disposed between signal lines and a capacitor connected between the signal lines and the ground are positionally inverted. That is, in the example of FIG. 5A, the former capacitor is disposed near the proximity antenna 10, whereas in the example of FIG. 11, the latter capacitor is disposed near the proximity antenna 10. As described above, various circuit arrangements can be employed for the matching circuit 52.

What is claimed is:

1. A proximity antenna comprising:

an approximately annular substrate comprising an insulating material;

a first wiring pattern formed alone the shape of the substrate on one surface of the substrate, the first wiring pattern being approximately annular and having one end and the other end; and a second wiring pattern formed along the shape of the substrate on the other surface of the substrate, the second wiring pattern being approximately annular and having one end and the other end, wherein the one end and the other end of the first wiring pattern and the one end and the other end of the second wiring pattern are disposed so that the first wiring pattern and the second wiring pattern are interdigitally coupled with each other in case both of the other end of the first wiring pattern and the other end of the second wiring pattern are supplied with a ground level, and the one end of the first wiring pattern and the one end of the second wiring pattern are connected to a pair of signal lines used in a differential, transmission system.

2. The proximity antenna as claimed in claim 1, the substrate further comprising:

first to third pad electrodes formed in line on the one surface;

fourth to sixth pad electrodes formed at positions in the other surface that overlap with the first to third pad electrodes, respectively, when viewed from the normal direction, of substrate;

a first through hole conductor for connecting the first pad electrode to the fourth pad electrode;

a second through hole conductor for connecting the second pad electrode to the fifth pad electrode; and a third through hole conductor for connecting the third pad electrode to the sixth pad electrode, wherein the first pad electrode is connected to the one end of the first wiring pattern, the second pad electrode is connected to the other end of the first wiring pattern, the fifth pad electrode is connected to the other end of the second wiring pattern, and the sixth pad electrode is connected to the one end of the second wiring pattern, thereby the one end and the other end of the first wiring pattern and the one end and the other end of the second wiring pattern are disposed so that the first wiring pattern and the second wiring pattern are interdigitally coupled with each other in case both of the other end of the first wiring pattern and the other end of the second wiring pattern are supplied with aground level, and the one end of the first wiring pattern and the one end of the second wiring pattern are connected to a pair of signal lines used in a differential transmission system.

3. A wireless communication device comprising a proximity antenna, wherein the proximity antenna comprising:

an approximately annular substrate comprising an insulating material;

a first wiring pattern formed along the shape of the substrate on one surface of the substrate, the first wiring pattern being approximately annular and having one end and the other end; and a second wiring pattern formed along the shape of the substrate on the other surface of the substrate, the second wiring pattern being approximately annular and having one end and the other end, wherein the one end and the other end of the first wiring pattern and the one end and the other end of the second wiring pattern are disposed so that the first wiring pattern and the second wiring pattern are interdigitally coupled with each other in case both of the other end of the first wiring pattern and the other end of the second wiring pattern are supplied with a ground level, and the one end of the first wiring pattern and the one end of the second wiring pattern are connected to a pair of signal lines used in a differential transmission system, the one end of the first wiring pattern and the one end of the second wiring pattern are connected to one line and the other line of the pair of signal lines, respectively, and both of the other end of the first wiring pattern and the other end of the second wiring pattern are supplied with the ground level.

* * * * *